US012655645B2

(12) United States Patent
Meyer et al.

(10) Patent No.: US 12,655,645 B2
(45) Date of Patent: Jun. 16, 2026

(54) GROOVED SURFACE CONCRETE FLOAT

(71) Applicant: Kraft Tool Company, Shawnee, KS (US)

(72) Inventors: Ronald G Meyer, Leawood, KS (US); Joseph H Burns, Lenexa, KS (US)

(73) Assignee: Kraft Tool Company, Shawnee, KS (US)

( * ) Notice: Subject to any disclaimer, the term of this patent is extended or adjusted under 35 U.S.C. 154(b) by 590 days.

(21) Appl. No.: 17/379,441

(22) Filed: Jul. 19, 2021

(65) Prior Publication Data

US 2023/0019419 A1 Jan. 19, 2023

(51) Int. Cl.
*E04F 21/24* (2006.01)
*E01C 19/44* (2006.01)

(52) U.S. Cl.
CPC ..... *E04F 21/241* (2013.01); *E01C 19/44* (2013.01)

(58) Field of Classification Search
CPC ..... E04F 21/241; E04F 21/161–162; E04F 21/06; E04F 21/08; E01C 19/44
USPC ..... 15/235.6, 235.4
See application file for complete search history.

(56) References Cited

U.S. PATENT DOCUMENTS 115,049 A * 5/1871 Fryer ..... E04F 21/16 15/235.6
3,140,500 A 7/1964 Pilla
5,269,625 A * 12/1993 Stewart ..... E04F 21/242 404/97
7,115,172 B1 * 10/2006 Teodorovich ..... E04F 21/16 29/90.3
8,684,627 B2 * 4/2014 Shaw ..... E04F 21/161 404/75
9,957,725 B2 * 5/2018 Maurer ..... E04F 21/163
2009/0044364 A1 * 2/2009 Verscheure ..... E04F 21/162 15/245.1
2021/0277672 A1 * 9/2021 Uulu ..... E04F 21/162

FOREIGN PATENT DOCUMENTS

EP 2289637 A1 * 3/2011 ..... B05C 17/10

OTHER PUBLICATIONS

UHMW-PE (Ultra High Molecular Weight Polyethylene, UHMW-PE), https://www.plasticsintl.com/shop-by-material/uhmw-pe, Available Jul. 20, 2020 (Year: 2020).*
Cadillac Concrete Products (Vancouver, Canada), Instagram post dated Jan. 1, 2019, https://www.instagram.com/p/BsHb_IhFOhj/ (Retrieved Nov. 6, 2023).

* cited by examiner

*Primary Examiner* — Michael A Gump
(74) *Attorney, Agent, or Firm* — AVEK IP, LLC

(57) ABSTRACT

A concrete float assembly includes an elongated finishing plate having patterns of fine grooves formed in and extending along a finishing surface of the plate. A handle member is secured to the plate to enable manipulation thereof.

20 Claims, 3 Drawing Sheets

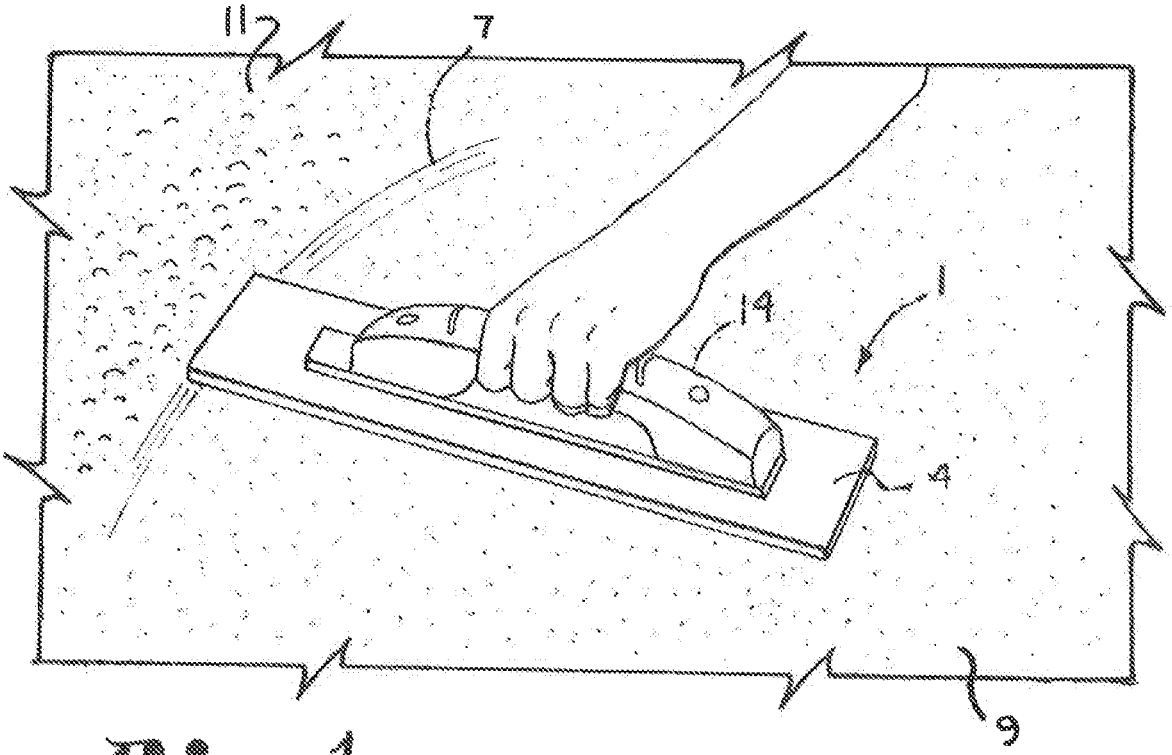
Fig. 1.
Fig. 2.
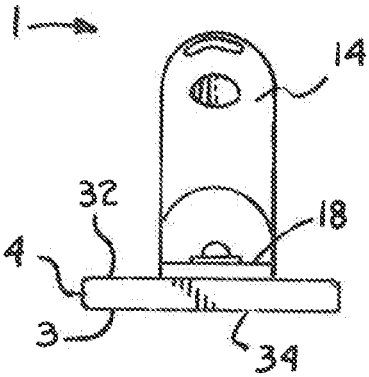
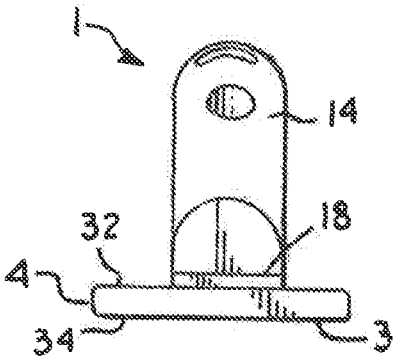
Fig. 3.

GROOVED SURFACE CONCRETE FLOAT

BACKGROUND OF THE INVENTION

Field of the Invention

The present invention is broadly concerned with concrete finishing tools and, more particularly, to such tools, particularly concrete float tools, having grooves on working surfaces thereof.

Background & Description of the Related Art

When concrete is used to form a relatively horizontal structure, such as a floor of a building, a walkway, a section of a road, or the like, the concrete slab is finished by first using a screed to strike off the poured concrete to a predetermined elevation, angle, and flatness. Once the concrete has been screeded to elevation, a float tool is used to work the fine aggregate (fines), also known as "cream" or "paste", to the surface above coarser aggregates. Floating also causes "bleed" water to rise to the surface where it can be allowed to evaporate.

So-called "bull" floats have long handles and are pushed or pulled across large areas of concrete. They are typically about 8 inches in width and may be 3 to 10 feet in length. Hand floats, also known as "darbies", range in widths from 3 to 5 inches and in lengths from 12 to 24 inches. Bull float are used for large areas while hand floats are used for smaller areas or for areas with existing structures which prevent bull floats from being used. Float tools may be made from metals, such as aluminum or magnesium, woods, and polymer materials, depending on the character of the concrete surface to be formed.

SUMMARY OF THE INVENTION

The present invention provides embodiments of improved concrete finishing tools with grooves in working surfaces thereof for floating a surface of a slab of poured concrete.

An embodiment of the concrete finishing tool or float includes an elongated concrete finishing plate having a first concrete finishing surface to engage concrete and an opposite second surface, the plate having opposite elongated lateral sides and opposite ends, a handle member secured to the plate on the second surface to enable manipulation of the plate, and a plurality of elongated, fine grooves formed along the first surface of the plate between the ends thereof, the grooves enhancing manipulation of components of poured concrete on which the assembly is used.

In certain embodiments the grooves are curved and radially spaced from adjacent grooves and are curved with a preferred radius of about 26 inches (66 cm) plus or minus about 25 percent. The grooves may be formed in radially spaced patterns which are repeated between the lateral sides of the plate and in varying depths. Each groove preferably has a depth less than about 0.5 mm (0.02 inch) and a similar range of widths. The grooves may have a spacing between adjacent grooves ranging from about 2 mm (0.079 inch) to about 0.02 mm (0.00079 inch).

The handle member may be removably secured to the finishing plate. The plate may have a plurality of the grooves formed on the second surface of the finishing plate and be reversible to position the second surface to enable finishing engagement of the second surface with concrete. The finishing plate is preferably formed of a polymer, especially an ultra high molecular weight polyethylene polymer.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 1 is a perspective view of a grooved surface concrete float assembly according to the present invention, shown in use on a slab of uncured poured concrete.

FIG. 2 is an enlarged front end view of the float assembly.

FIG. 3 is an enlarged rear end view of the float assembly.

DETAILED DESCRIPTION OF THE PREFERRED EMBODIMENTS

Figure 4:
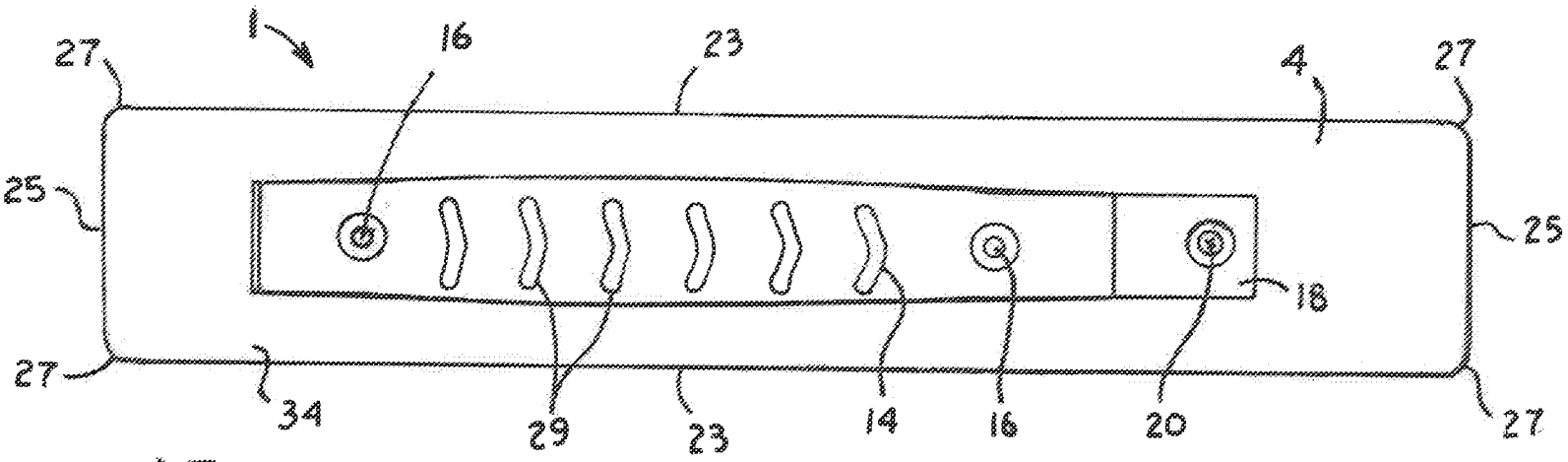
FIG. 4 is an enlarged top plan view of the float assembly.
Figure 5:
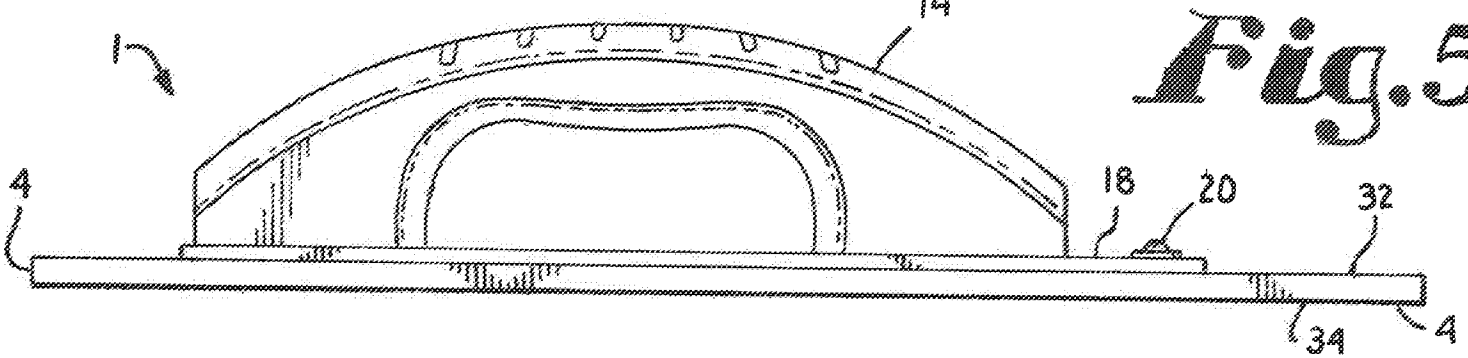
FIG. 5 is an enlarged side elevational view of the float assembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference number 1 generally designates an embodiment of a concrete float assembly having grooves 2 on a working or finishing surface 3 of a finishing plate 4 of the assembly 1 of the present invention. The assembly 1 is generally used in concrete finishing operations to bring fine aggregates 7, including mainly cement and sand, of a freshly poured concrete slab 9 above coarser aggregates 11, such as gravel and the like. It is foreseen that the float, may be used with various materials related to concrete during finishing operations thereof.

Referring to FIGS. 1-5, the illustrated float assembly 1 generally includes the finishing plate or blade 4 having a handle member or handle 14 secured thereto, as by fasteners 16 (FIGS. 4 and 6), such as screws and nuts. The illustrated assembly 1 has a mounting strip or bracket 18 securing the handle 14 to the finishing plate 4, as by one or more fasteners 20 (FIG. 4), such as screws. Referring particularly to FIG. 4, the illustrated finishing plate 4 has an elongated rectangular shape with elongated side surfaces or sides 23 and short end surfaces or ends 25. The sides 23 and ends 25 may be connected by rounded corners 27.

The illustrated float assembly 1 is sized and configured as a hand float which is typically utilized by one hand of a concrete finisher and applied to the surface of the slab 9 using side-to-side sweeping motions. As such, the illustrated handle 14 is suitable for a hand float. The handle 14 may include grip features 29 (FIG. 4), which may be raised or recessed areas, to enhance gripping the handle 14 to manipulate the assembly 1. The float assembly 1 may also be a so-called bull float which employs a long pole type handle (not shown) for manipulating a larger finishing plate 4. Exemplary bull floats long pole handles are disclosed in U.S. Pat. Nos. 4,856,932 and 4,982,437, the disclosures of which are incorporated by reference herein in their entireties.

The finishing plate 4 may be formed of a suitable material such as a wooden material (not shown), a metal material such as aluminum or magnesium, or a polymer, such as an ultra high molecular weight polyethylene polymer or UHMWPE. Such an UHMWPE polymer is highly resistant to corrosive chemicals, has extremely low moisture absorption and a very low coefficient of friction, is self-lubricating, and is highly resistant to abrasion.

The illustrated finishing plate 4 has an upper or top surface 32 and a lower or bottom surface 34. Typically, the bottom surface 34 forms the finishing surface 3 of the plate 4 and has the grooves 2 formed thereon. It is also foreseen that the grooves 2 could be formed on the top surface 32, and the finishing plate 4 could be made conveniently removable from the handle 14 and mounting strip 18. By this means, the finishing plate 4 could be reversed to extend the useful life of the finishing plate 4 should the grooves 2 of finishing surface 3 become worn from use.

Figure 6:
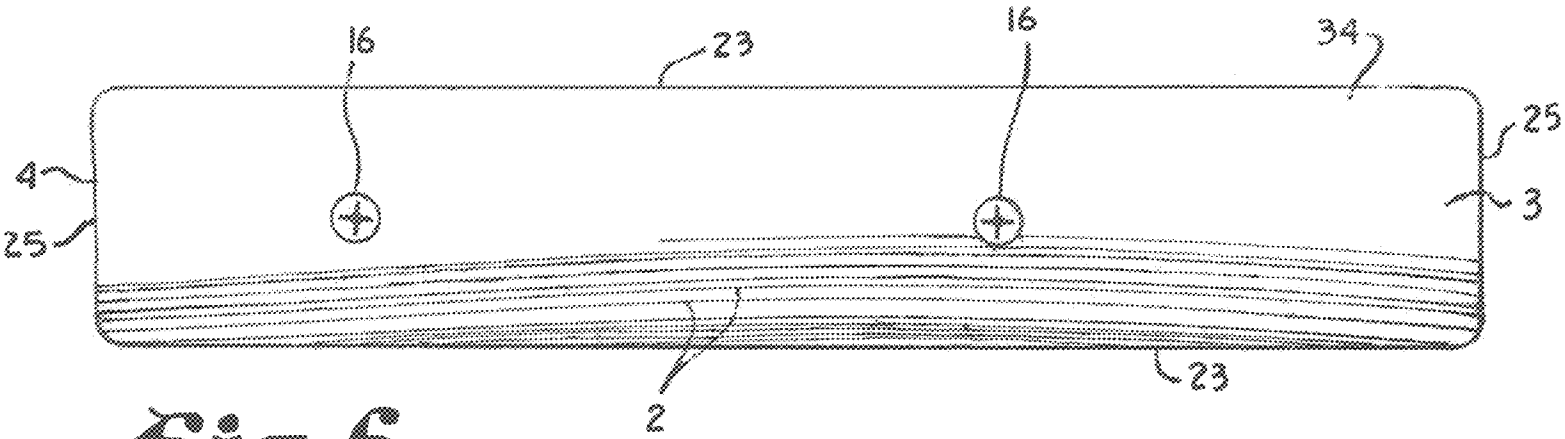
FIG. 6 is an enlarged bottom plan view of the float assembly that shows a plurality of grooves on a finishing surface of a finishing plate of the float assembly.
Figure 7:
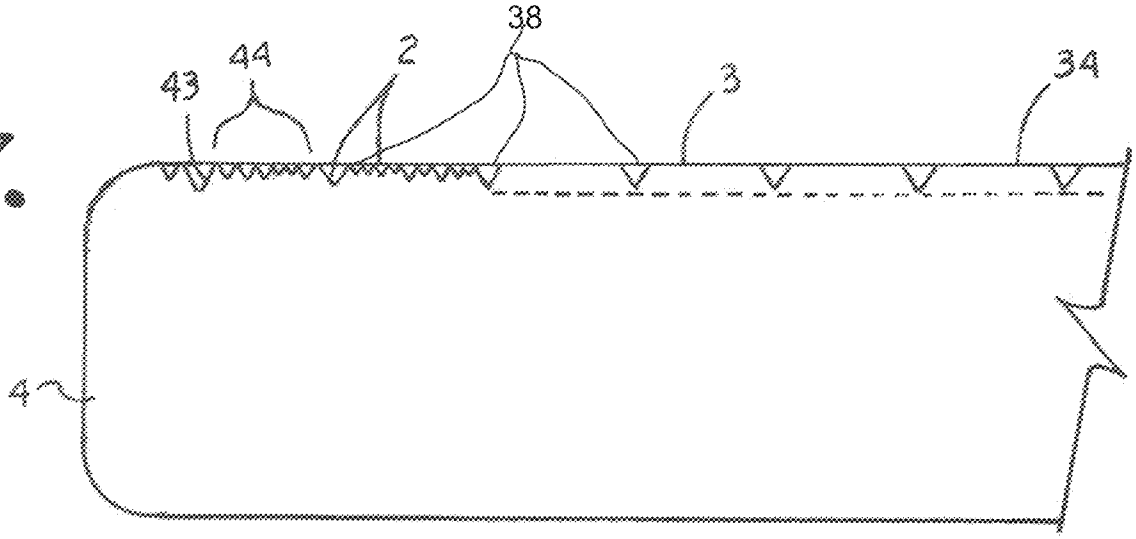
FIG. 7 is a greatly enlarged inverted end view of the finishing plate of the float assembly that diagrammatically illustrates patterns of grooves formed on the finishing surface of the float assembly.

As illustrated in FIG. 7, embodiments of the float assembly 1 can be provided with repeating patterns 38 of the grooves 2 on the finishing surface 3 of the finishing plate 4. The patterns 38 may include grooves 2 positioned at varying spacing between adjacent grooves and at varying depths. As shown in FIG. 6, the grooves 2 extend substantially longitudinally along the finishing surface 3 between the ends 25 of the plate 4. FIG. 6 only shows the grooves 2 on only a portion of the finishing surface 3 for graphic convenience. Typically, the grooves 2 would cover the entire finishing surface 3.

The grooves 2 are preferably substantially parallel and may be straight or preferably, as illustrated, curved. Embodiments of the float assembly 1 may have grooves 2 with radii of about 26 inches (about 66 cm), plus or minus about 25 percent. Individual grooves 2 may have widths and depths roughly similar to the width and depth of human fingerprints and typically less than about 0.5 mm (about 0.02 inch). Embodiments of the float assembly 1 may have grooves 2 spaced apart distances ranging from about 2 mm (0.079 inch) to about 0.02 mm (0.00079 inch). The patterns 38 may repeat at about 0.875 inch (about 22 mm) plus or minus about 25 percent. It is foreseen that grooves 2 with greater or lesser dimensions and spacings could be beneficially employed in the float assembly 1. In the illustrated embodiment the grooves 2 are shown in patterns of a deeper groove 43 followed by six or seven grooves 44 that are about half as shallow as each deeper grove 43.

It is to be understood that while certain forms of the present invention have been illustrated and described herein, it is not to be limited to the specific forms or arrangement of parts described and shown.

What is claimed as new and desired to be secured by Letters Patent is:

1. A concrete finishing float assembly comprising:
(a) an elongated concrete finishing plate having a first concrete finishing surface to engage concrete and an opposite second surface, the plate having first and second opposite elongated lateral sides and opposite ends;
(b) a handle member secured to the plate on the second surface to enable manipulation of the plate; and
(c) a plurality of elongated grooves formed along the first surface of the plate that extend across the entire first surface between the sides thereof and each groove extending to and between the ends thereof, the grooves are uniformly longitudinally curved along an entire length of the plate and spaced radially from each and every other groove so that all of the grooves on the first finishing surface are aligned with all of the other grooves on the first finishing surface, and each groove being parallel to every other groove, the grooves enhancing manipulation of components of poured concrete on which the assembly is used.

2. The assembly as set forth in claim 1 wherein:
(a) the grooves are curved and radially spaced between adjacent grooves; and
(b) the grooves have a radius of 26 inches (66 cm) plus or minus 25 percent.

3. The assembly as set forth in claim 1 wherein:
(a) the grooves are formed in radially spaced patterns which extend between the ends of the plate and are repeated between the lateral sides of the plate.

4. The assembly as set forth in claim 1 wherein:
(a) the grooves are formed in radially spaced parallel patterns which are repeated between the lateral sides of the plate.

5. The assembly as set forth in claim 1 wherein:
(a) the grooves are formed in varying depths.

6. The assembly as set forth in claim 1 wherein:
(a) each groove has a depth less than 0.5 mm (0.02 inch).

7. The assembly as set forth in claim 1 wherein:
(a) the grooves have a spacing between adjacent grooves ranging from 2 mm (0.079 inch) to 0.02 mm (0.00079 inch).

8. The assembly as set forth in claim 1 wherein:
(a) the handle member is removably secured to the finishing plate.

9. The assembly as set forth in claim 1 wherein:
(a) the finishing plate is formed of a polymer.

10. The assembly as set forth in claim 1 wherein:
(a) the finishing plate is formed of an ultra high molecular weight polyethylene polymer.

11. A concrete finishing float assembly comprising:
(a) an elongated concrete finishing plate having a first concrete finishing surface to engage freshly poured concrete and an opposite second surface, the plate having first and second opposite elongated lateral sides and opposite ends;
(b) a handle member secured to the plate on the second surface to enable manipulation of the plate;
(c) a plurality of elongated grooves formed along the first surface of the plate that extend across the entire first surface between the sides thereof and between the ends thereof, the grooves enhancing manipulation of components of the poured concrete on which the assembly is used;
(d) the grooves being uniformly longitudinally curved from end to end thereof and are radially spaced from adjacent grooves and from the first side and parallel to each and every other groove such that all of the grooves on the first concrete finishing surface align with each other; and
(e) the grooves being formed in radially spaced patterns which are repeated between and extend to the lateral sides of the plate.

12. The assembly as set forth in claim 11 wherein:
(a) the grooves have a radius of 26 inches (66 cm) plus or minus 25 percent.

13. The assembly as set forth in claim 11 wherein:

(a) the grooves are formed in varying depths.

14. The assembly as set forth in claim 11 wherein:

(a) each groove has a depth less than 0.5 mm (0.02 inch).

15. The assembly as set forth in claim 11 wherein:

(a) the grooves have a spacing between adjacent grooves ranging from 2 mm (0.079 inch) to 0.02 mm (0.00079 inch).

16. The assembly as set forth in claim 11 wherein:

(a) the finishing plate is formed of an ultra high molecular weight polyethylene polymer.

17. A concrete finishing float assembly comprising:

(a) an elongated concrete finishing plate formed of a polymer and having a first concrete finishing surface to engage freshly poured concrete and an opposite second surface, the plate having first and second opposite elongated lateral sides and opposite ends;

(b) a handle member secured to the plate on the second surface to enable manipulation of the plate;

(c) a plurality of elongated grooves formed along the first surface of the plate and extending across the entire first surface between the sides thereof and extending entirely between the ends thereof, the grooves enhancing manipulation of components of the poured concrete on which the assembly is used;

(d) the grooves having varying depths, being uniformly longitudinally curved, and being radially spaced between adjacent grooves; and (e) the grooves being parallel to each and every other groove and formed radially spaced from each other and from the first side such that all of the grooves on the first surface of the plate align with one another.

18. The assembly as set forth in claim 17 wherein:

(a) the grooves have a radius of 26 inches (66 cm) plus or minus 25 percent.

19. The assembly as set forth in claim 17 wherein:

(a) each groove has a depth less than 0.5 mm (0.02 inch).

20. The assembly as set forth in claim 17 wherein:

(a) the grooves have a spacing between adjacent grooves ranging from 2 mm (0.079 inch) to 0.02 mm (0.00079 inch).

* * * * *